US011976665B2

(12) United States Patent
Arakawa et al.

(10) Patent No.: US 11,976,665 B2
(45) Date of Patent: May 7, 2024

(54) COMPRESSOR

(71) Applicant: MITSUBISHI HEAVY INDUSTRIES ENGINE & TURBOCHARGER, LTD., Sagamihara (JP)

(72) Inventors: Takuya Arakawa, Tokyo (JP); Naomichi Shibata, Sagamihara (JP)

(73) Assignee: MITSUBISHI HEAVY INDUSTRIES ENGINE & TURBOCHARGER LTD., Sagamihara (JP)

( * ) Notice: Subject to any disclaimer, the term of this patent is extended or adjusted under 35 U.S.C. 154(b) by 6 days.

(21) Appl. No.: 17/796,483

(22) PCT Filed: Feb. 20, 2020

(86) PCT No.: PCT/JP2020/006671

§ 371 (c)(1),
(2) Date: Jul. 29, 2022

(87) PCT Pub. No.: WO2021/166136

PCT Pub. Date: Aug. 26, 2021

(65) Prior Publication Data

US 2023/0048172 A1 Feb. 16, 2023

(51) Int. Cl.

| | |
|---|---|
| ***F04D 29/059*** | (2006.01) |
| ***F04D 17/10*** | (2006.01) |
| ***F04D 29/66*** | (2006.01) |

(52) U.S. Cl.

CPC ..... *F04D 29/059* (2013.01); *F04D 17/10* (2013.01); *F04D 29/668* (2013.01)

(58) Field of Classification Search

CPC ..... F04D 29/059; F04D 17/10; F04D 29/668; F04D 25/0606

See application file for complete search history.

(56) References Cited

U.S. PATENT DOCUMENTS 3,781,073 A * 12/1973 Jorn ..... F16F 1/3863 403/228
4,277,115 A * 7/1981 Stuwe ..... F16C 23/043 384/220

(Continued)

FOREIGN PATENT DOCUMENTS

JP 7-208462 A 8/1995
JP 2004-92750 A 3/2004

(Continued)

OTHER PUBLICATIONS

International Preliminary Report on Patentability and English translation of the Written Opinion of the International Searching Authority for International Application No. PCT/JP2020/006671, dated Sep. 1, 2022, with an English translation.

(Continued)

*Primary Examiner* — Aaron R Eastman
(74) *Attorney, Agent, or Firm* — BIRCH, STEWART, KOLASCH & BIRCH, LLP

(57) ABSTRACT

A compressor according to an embodiment includes: a rotational shaft provided with a compressor impeller on one end side; a rolling bearing device for rotatably supporting the rotational shaft; and a housing for housing the rolling bearing device. The rolling bearing device includes: an inner ring mounted on the rotational shaft; an outer ring supported by the housing with application of a load from the housing in an axial direction of the rotational shaft; a rolling element disposed between the inner ring and the outer ring; an elastic member disposed on an outer circumferential side of the outer ring so as to come into contact with the housing; and a sliding portion disposed on one end side of the outer ring in the axial direction so as to come into contact with the housing.

9 Claims, 3 Drawing Sheets

(56) References Cited

U.S. PATENT DOCUMENTS

| | | | | |
|---|---|---|---|---|
| 4,582,368 | A * | 4/1986 | Fujita | F16C 33/206 384/279 |
| 4,597,677 | A * | 7/1986 | Hagiwara | F16C 17/042 384/106 |
| 9,970,450 | B1 * | 5/2018 | Kelly | F04D 29/284 |
| 2012/0306206 | A1 * | 12/2012 | Agrawal | F04D 25/0606 290/52 |
| 2017/0204868 | A1 | 7/2017 | Oshita et al. | |
| 2018/0080499 | A1 * | 3/2018 | An | F16C 27/066 |
| 2020/0040903 | A1 | 2/2020 | Lizuka et al. | |

FOREIGN PATENT DOCUMENTS

| | | | |
|---|---|---|---|
| JP | 2008-190376 | A | 8/2008 |
| JP | 6344102 | B2 | 6/2018 |
| WO | WO 2018/181186 | A1 | 10/2018 |

OTHER PUBLICATIONS

International Search Report and Written Opinion of the International Searching Authority for International Application No. PCT/JP2020/006671, dated Apr. 7, 2020.

* cited by examiner

COMPRESSOR

TECHNICAL FIELD

The present disclosure relates to a compressor.

BACKGROUND

A rotational shaft system including an impeller such as an electric compressor rotates at a high rotation speed, and thus is rotatably supported by a pair of rolling bearings or the like. Further, in order to suppress a vibration of the rotational shaft system generated during the rotation, an elastic member such as an O-ring having a vibration damping effect is interposed between an inner peripheral surface of a housing and an outer peripheral surface of the rolling bearing. Patent Document 1 discloses an electric compressor where a rotational shaft is supported by a rolling bearing. In the electric compressor, in order to prevent provision of the above-described elastic member from causing a radial axial misalignment in the rotational shaft between the pair of rolling bearings, whereby an eccentric load is applied to the rolling bearings, transmission of the vibration of the rotational shaft to the housing is prevented by eliminating the above-described elastic member, and interposing an elastic sheet between a bearing sleeve for supporting the rolling bearings and an axial end surface of the housing.

CITATION LIST

Patent Literature

Patent Document 1: JP6344102B

SUMMARY

Technical Problem

In order to eliminate backlash of a rolling bearing for supporting a rotational shaft of a compressor at an axial position, axial pressurization is applied to the rolling bearing to bring an outer ring into contact with a housing wall surface to be fixed. In this case, the contact between the housing wall surface and the outer ring is a metal-to-metal contact in a dry (non-lubrication) state, deteriorating slidability of a contact surface between the housing wall surface and the outer ring. The present inventors have found that if the sliding between the housing wall surface and the outer ring is not performed smoothly, the vibration damping effect by the elastic member interposed between an inner peripheral surface of a housing and an outer peripheral surface of the rolling bearing does not work well on a rotational shaft system, and a vibration damping effect on the rotational shaft system is reduced. Further, since the outer ring of the rolling bearing and the housing are made of different materials, the problem arises in that wear is likely to occur on one side of the contact surface between the housing and the outer ring and the wear causes the axial position of the rolling bearing to deviate from an initial position. In the electric compressor disclosed in Patent Document 1, the contact surface between the housing wall surface and the outer ring remains in contact, and the slidability of the contact surface is not improved, making it impossible to escape the above problem.

The present disclosure was made in view of the above problem, and an object of the present disclosure is to enable smooth sliding of the contact surface between the housing and the outer ring to suppress damping of the vibration damping effect on the rotational shaft system, and to suppress wear of the contact surface.

Solution to Problem

In order to achieve the above object, a compressor according to the present disclosure includes: a rotational shaft provided with a compressor impeller on one end side; a rolling bearing device for rotatably supporting the rotational shaft; and a housing for housing the rolling bearing device. The rolling bearing device includes: an inner ring mounted on the rotational shaft; an outer ring supported by the housing with application of a load from the housing in an axial direction of the rotational shaft; a rolling element disposed between the inner ring and the outer ring; an elastic member disposed on an outer circumferential side of the outer ring so as to come into contact with the housing; and a sliding portion disposed on one end side of the outer ring in the axial direction so as to come into contact with the housing.

Advantageous Effects

With the compressor according to the present disclosure, since the above-described sliding portion is provided, smooth sliding between the housing wall surface and the outer ring of the rolling bearing is possible, making it possible to suppress the reduction in vibration damping effect on the rotational shaft system by the elastic member. Further, it is possible to suppress the wear of the sliding surface of the housing and the outer ring, making it possible to suppress the problem that the axial position of the rolling bearing deviates from the initial position.

DETAILED DESCRIPTION

Figure 1:
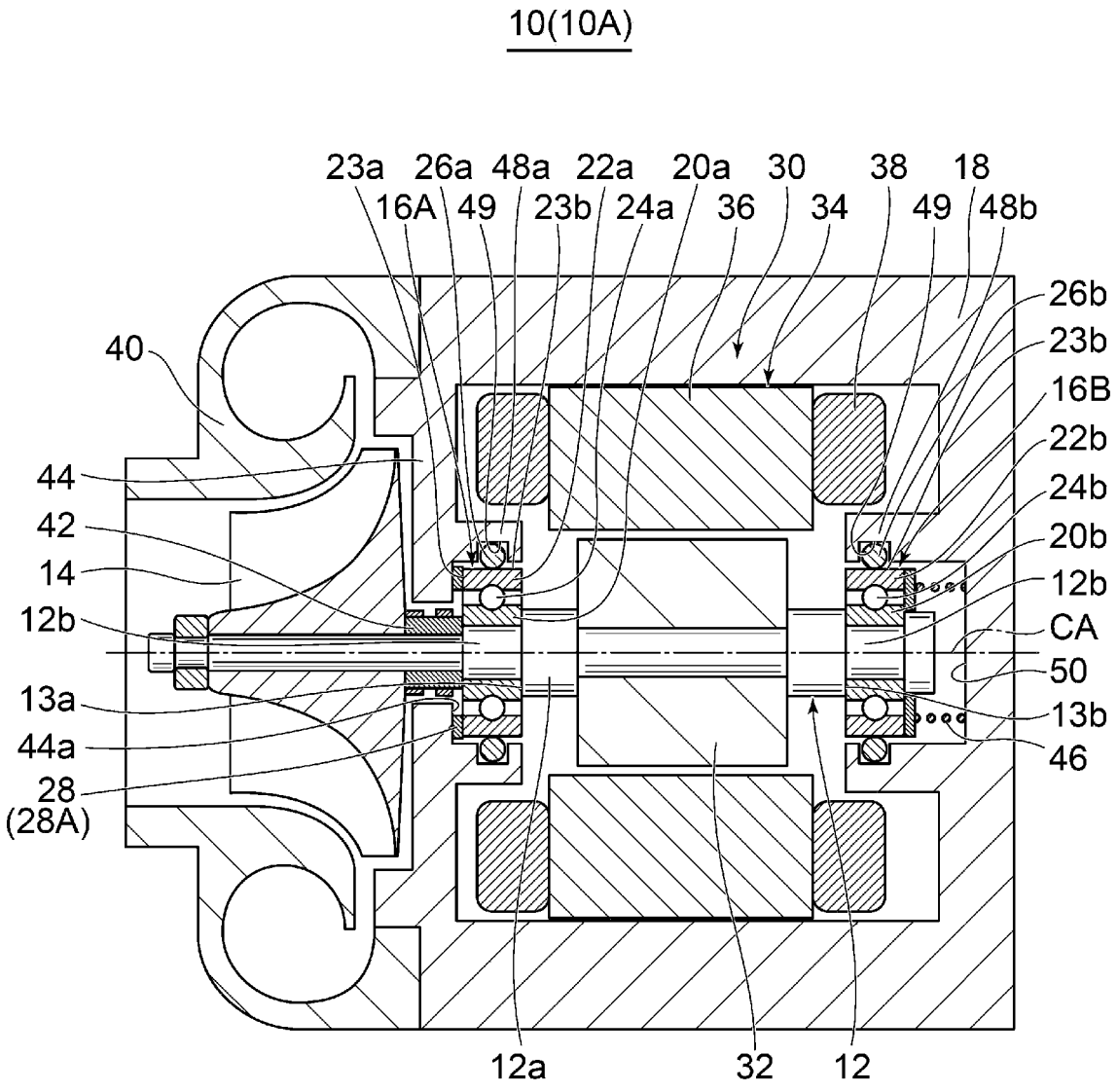
FIG. 1 is a vertical cross-sectional view of an electric compressor according to an embodiment.

Some embodiments of the present invention will be described below with reference to the accompanying drawings. It is intended, however, that unless particularly specified, dimensions, materials, shapes, relative positions and the like of components described or shown in the drawings as the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, an expressions such as "comprising", "including", "having", "containing", and "constituting" one constitutional element are not intended to be exclusive of other constitutional elements.

Figure 2:
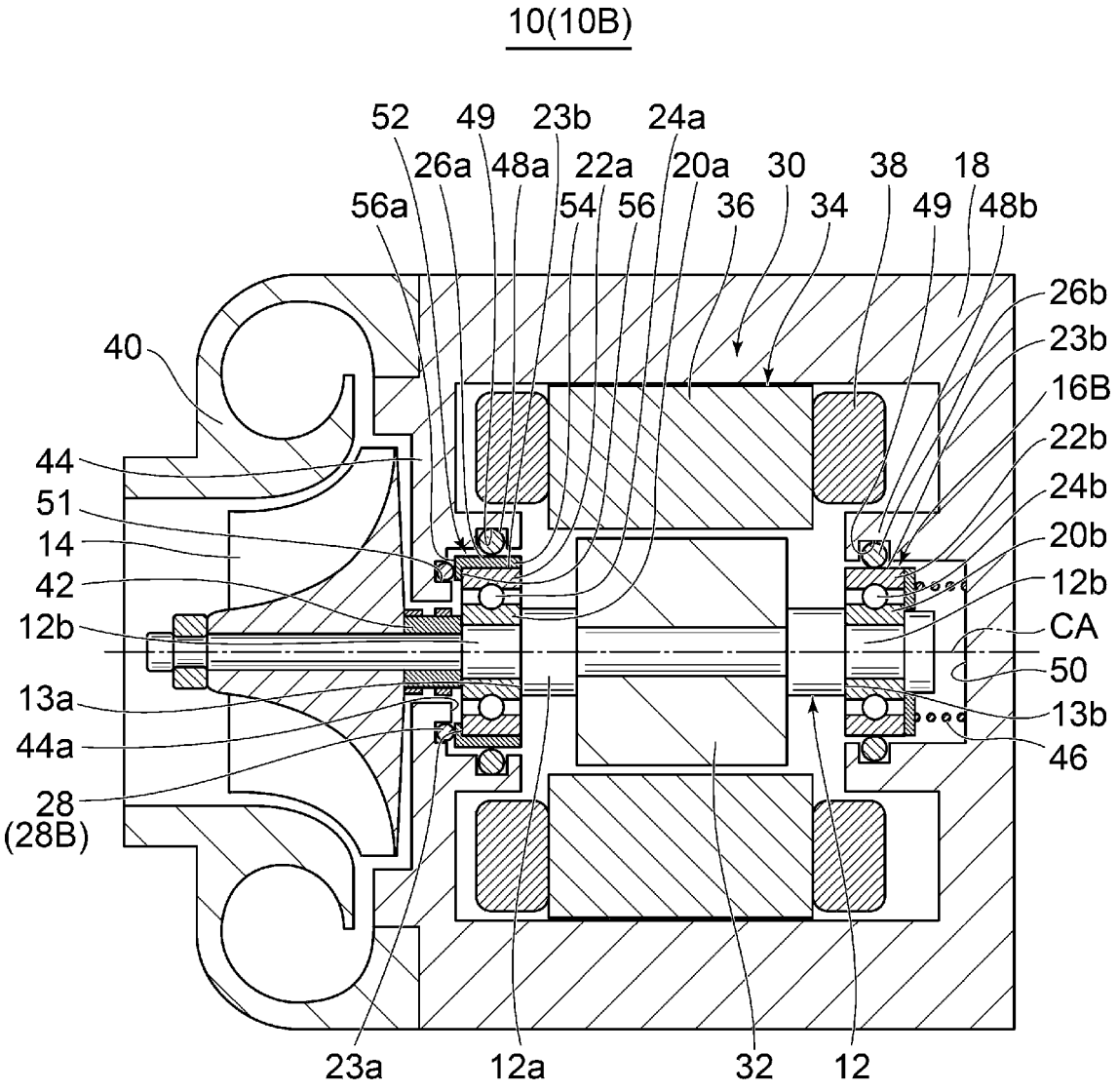
FIG. 2 is a vertical cross-sectional view of the electric compressor according to an embodiment.
Figure 3:
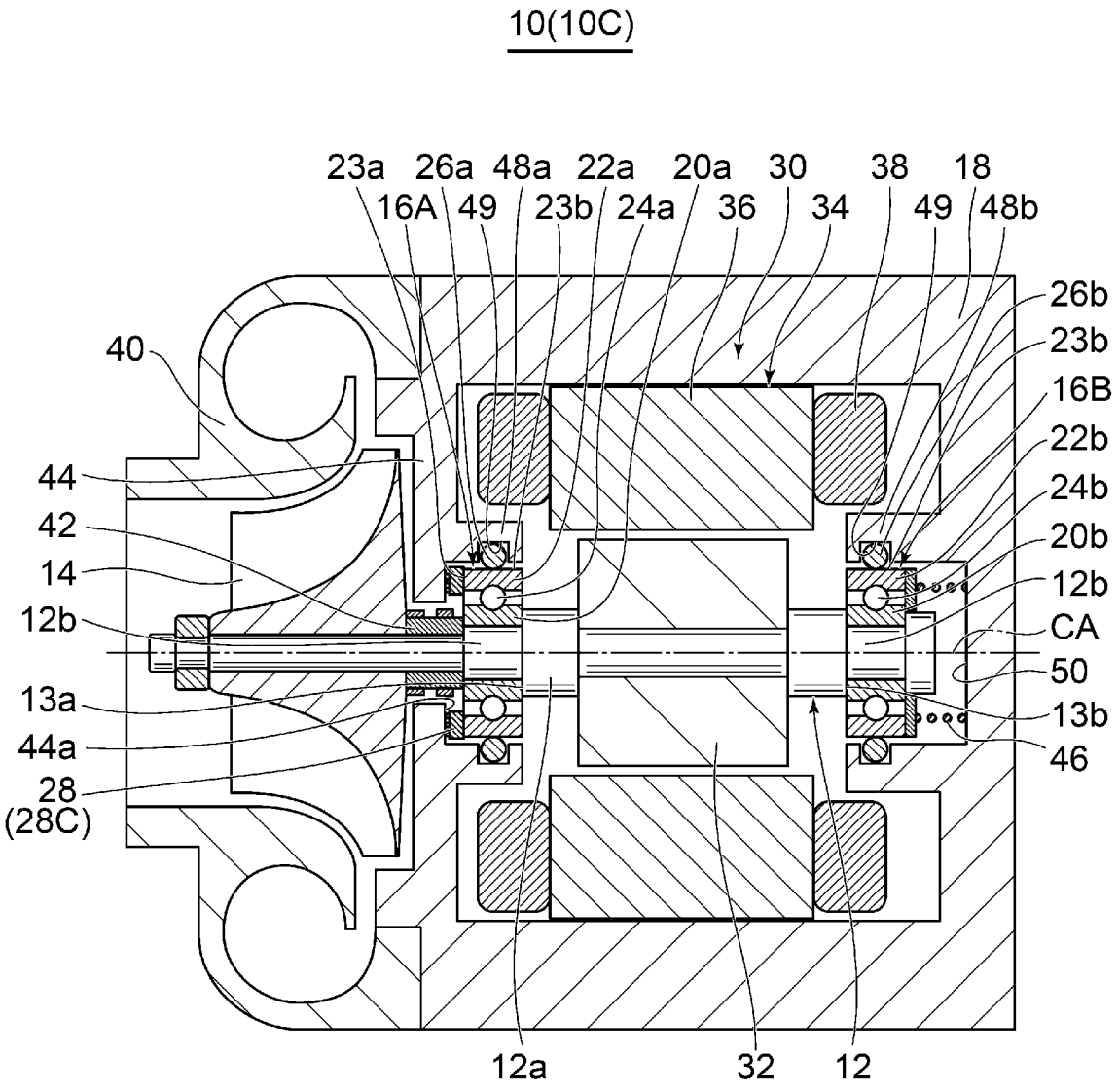
FIG. 3 is a vertical cross-sectional view of the electric compressor according to an embodiment.

FIGS. 1 to 3 are, respectively, vertical cross-sectional views showing some embodiments applied to an electric compressor. In an electric compressor 10 (10A, 10B, 10C) shown in FIGS. 1 to 3, a compressor impeller 14 is disposed on one end side of a rotational shaft 12, and a pair of first rolling bearing 16A and second rolling bearing 16B for rotatably supporting the rotational shaft 12 about an axis CA are disposed in a housing 18. The first rolling bearing 16A is disposed in the vicinity of the compressor impeller 14 in the axis CA direction of the rotational shaft 12, and the second rolling bearing 16B is disposed on another end side of the rotational shaft 12 (an opposite side to the compressor impeller 14). The first rolling bearing 16A corresponds to a rolling bearing device according to the present invention.

The first rolling bearing 16A is composed of an inner ring 20*a* fixed to the rotational shaft 12 and rotating together with the rotational shaft 12, an outer ring 22*a* mounted so as not to rotate to the housing 18 side, and a rolling element 24*a* disposed between the inner ring 20*a* and the outer ring 22*a* to guide a rotation of the inner ring 20*a* about the axis CA. The second rolling bearing 16B is composed of an inner ring 20*b* fixed to the rotational shaft 12 and rotating together with the rotational shaft 12, an outer ring 22*b* mounted so as not to rotate to the housing 18 side, and a rolling element 24*b* disposed between the inner ring 20*b* and the outer ring 22*b* to guide a rotation of the inner ring 20*b* about the axis CA.

The outer ring 22*a* is supported by the housing 18 in a state where a load is applied in the axial direction of the rotational shaft 12 by the housing 18. In the embodiments shown in FIGS. 1 to 3, the load applying means includes a spring member 46 disposed between the second rolling bearing 16B and an inner wall of the housing 18. The spring member 46 applies, to the second rolling bearing 16B, a spring force directed to the first rolling bearing 16A side along the axis CA direction. The first rolling bearing 16A and the second rolling bearing 16B are mounted on a small diameter portion 12*b* of the rotational shaft 12, and an end surface of the inner ring 20*a* on one end side (compressor impeller 14 side) in the axis CA direction is not in contact with an opposite surface of a sleeve 42, and an end surface of the inner ring 20*a* on another end side is in contact with a step surface 13*a* formed at a boundary between the small diameter portion 12*b* and a large diameter portion 12*a*. End surfaces of the inner ring 20*b* on the one end side (first rolling bearing 16A side) and the another end side in the axis CA direction are in contact with a step surface 13*b* formed at the boundary between the large diameter portion 12*a* and the small diameter portion 12*b*.

The spring force of the spring member 46 is transmitted to the rotational shaft 12 via the inner ring 20*b* and the step surface 13*b*, and further transmitted to the outer ring 22*a* of the first rolling bearing 16A via the step surface 13*a* and the inner ring 20*a*. Thus, the outer ring 22*a* is pressed against the housing 18 and supported by the housing 18. The load applying means is merely one embodiment and may be another means, for example, a means of applying a force that directly pushes another end surface of the rotational shaft 12 on the second rolling bearing 16B side toward the first rolling bearing 16A side along the axis CA direction.

Further, in the electric compressor 10, elastic members 26*a* and 26*b* are disposed so as to come into contact with the inner peripheral surface of the housing 18 on the outer circumferential side of the outer rings 22*a* and 22*b*, and a sliding portion 28 is disposed so as to come into contact with the housing 18 on one end side of the outer ring 22*a* (compressor impeller 14 side) in the axis CA direction.

While the electric compressor 10 is in operation, the rotational shaft 12 rotates at a high speed. The elastic members 26*a* and 26*b* have a function of suppressing a radial vibration of the rotational shaft 12 generated during the rotation, and according to the present embodiment, with the sliding portion 28, sliding is performed smoothly between the housing 18 and the outer ring 22*a*. Therefore, since the vibration damping effect on the rotational shaft system by the elastic members 26*a* and 26*b* is sufficiently exerted, it is possible to suppress the vibration generated in the rotational shaft system by the vibration damping effect. Further, since the sliding portion 28 is interposed between the housing 18 and the outer ring 22*a*, it is possible to suppress wear of the housing 18 or the outer ring 22*a*. Thus, it is possible to suppress a problem that positions of the first rolling bearing 16A and the second rolling bearing 16B in the axis CA direction deviate from initial positions, respectively.

Since each of the embodiments shown in FIGS. 1 to 3 is an embodiment applied to the electric compressor, an electric motor 30 is disposed in the housing 18. The electric motor 30 is composed of a rotor 32 fixed to the rotational shaft 12, and a stator 34 disposed around the rotor 32 and fixed to the inner peripheral surface of the housing 18. The stator 34 includes a stator core 36 and a coil 38 wound around the stator 34. A magnetic field is generated by a current flowing through the coil 38, and a force for rotating the rotational shaft 12 is generated.

Further, the electric compressors 10 (10A to 10C) each include a compressor cover 40 for housing the compressor impeller 14. The rolling elements 24*a* and 24*b* of the first rolling bearing 16A and the second rolling bearing 16B are each constituted by, for example, a ball, a roller (runner), a needle, or the like. The sleeve 42 is disposed around the rotational shaft 12 between the first rolling bearing 16A and the compressor impeller 14, and the sleeve 42 arranges the compressor impeller 14 and the first rolling bearing 16A at predetermined positions in the axis CA direction.

In an embodiment, as shown in FIGS. 1 to 3, the elastic members 26*a* and 26*b* are disposed between the inner peripheral surface of the housing 18 and an outer circumferential surface 23*b* of the outer ring 22*a* or the outer ring 22*b*. The elastic members 26*a* and 26*b* are each constituted by, for example, an elastic O-ring. Further, the sliding portion 28 is constituted by a sliding member disposed between one end surface (such as an end surface 23*a*) on the one end side of the outer ring 22*a* in the axis CA direction and an inner end surface (such as an inner end surface 44*a*) on the one end side of the housing 18 in the axis CA direction. The sliding member is constituted by, for example, the sliding member 28 (28A, 28B, 28C) shown in each of FIGS. 1 to 3.

According to the present embodiment, since the elastic members 26*a* and 26*b* are disposed between the inner peripheral surface of the housing 18 and the outer circumferential surface 23*b* of the outer ring 22*a* or the outer ring 22*b*, the radial direction of the rotational shaft system and a direction, in which vibration damping forces of the elastic members 26*a* and 26*b* are applied, coincide with each other. Thus, the vibration damping effects by the elastic members 26*a* and 26*b* can be maximized against the radial vibration of the rotational shaft system. Further, since the sliding portion 28 is constituted by the sliding member disposed between the housing 18 and the outer ring 22*a* of the first rolling bearing 16A, the outer ring 22*a* and the housing 18 do not contact directly. Therefore, it is possible to suppress wear of a sliding contact surface of the outer ring 22*a* and the housing 18 which has conventionally been caused by the direct contact between the outer ring 22*a* and the housing 18.

In an embodiment, as shown in FIGS. 1 to 3, a partition wall 44 protruding radially inward of the rotational shaft 12 from the housing 18 is formed around the sleeve 42. Then, an inner end surface 44*a* of the partition wall 44 is disposed so as to face the end surface 23*a* formed on the one end side of the outer ring 22*a* of the first rolling bearing 16A. Each of the sliding members 28 (28A to 28C) disposed between the end surface 23*a* and the inner end surface 44*a* makes the end surface 23*a* and the inner end surface 44*a* slidable.

In an embodiment, as shown in FIGS. 1 to 3, annular portions 48*a* and 48*b* are formed which extend in the axis CA direction from the partition wall 44 or the inner wall surface on the one end side of the housing 18 in the axis CA direction on both sides of the electric motor 30 in the housing 18. Then, annular recesses 49 are formed in inner surfaces of the annular portions 48*a* and 48*b* opposite to the outer circumferential surfaces 23*b* of the outer rings 22*a* and 22*b*, and the annular elastic members 26*a* and 26*b* are fitted into the recesses 49, respectively. In the annular portion 48*b* formed on the second rolling bearing 16B side, the spring member 46 is disposed in a recess 50 formed on the inner side of the annular portion 48*b*.

In an embodiment, as shown in FIG. 1, the sliding member 28 (28A) is constituted by a resin plate member. For example, it is possible to use a plate member made of a rubber material, or a fluororesin having high surface slipperiness such as PEEK or PTFE. Alternatively, a film capable of maintaining the above-described slidability with the inner end surface 44*a* of the housing 18 may be attached to the surface of a plate member made of another material. With the present embodiments, it is possible to reduce the cost of the sliding member, as well as to easily dispose the sliding member 28 (28A), while ensuring the slidability between the housing 18 and the inner end surface 44*a*.

The sliding member 28 (28A) may be disposed only partially in the circumferential direction of the rotational shaft 12, or an annular plate member covering the entire circumference in the circumferential direction of the rotational shaft 12 may be disposed. Even if the sliding member 28 (28A) is disposed only partially in the circumferential direction of the rotational shaft 12, as long as the slidability can be given between the inner end surface 44*a* of the housing 18 and the outer ring 22*a* of the first rolling bearing 16A, it is possible to exert the vibration damping effect on the rotational shaft 12 by the elastic members 26*a* and 26*b*.

As another embodiment, besides the sliding member 28 (28A), it is possible to use a member provided with slidability on a surface in sliding contact with the housing 18, by performing surface treatment on a plate member (such as a metal plate member) made of a material other than resin.

In an embodiment, as shown in FIG. 2, the sliding member 28 (28B) is constituted by an annular elastic member. As the sliding member 28 (28B), it is possible to use, for example, an O-ring having elasticity such as a member made of rubber. Thus, it is possible to suppress the vibration of the rotational shaft system by using the existing elastic member such as the O-ring, making it possible to reduce the cost of the sliding member, as well as to easily dispose the sliding member. Further, since the annular sliding member 28 (28B) is disposed in the entire circumferential region of the rotational shaft 12, it is possible to improve the slidability between the housing 18 and the outer ring 22*a*.

In an embodiment, as shown in FIG. 2, a recess 51 is formed in the inner end surface 44*a* of the housing 18, where the sliding member 28 (28B) is disposed, to cause the sliding member 28 (28B), such as the O-ring, to be fitted into the recess 51. Thus, the sliding member 28 (28B) can be fixed at the predetermined position on the inner end surface 44*a*.

In an embodiment, as shown in FIG. 3, the sliding member 28 (28C) is constituted by a dry bearing. In the present embodiment, since the sliding member 28 (28C) is constituted by the dry bearing, it is possible to stably exhibit a high level of sliding performance between the housing 18 and the outer ring 22*a* without supplying oil. Further, since oil supply is unnecessary, it is unnecessary to form an oil-supply channel, and it is possible to avoid contamination due to oil supply.

Although various embodiments of the sliding portion 28 have been described above in detail, the sliding portion 28 is not limited to these embodiments. In short, it is only necessary that the sliding portion 28 has better slidability with respect to the inner end surface 44*a* of the housing 18 as compared with the case where the end surface 23*a* of the outer ring 22*a* opposite to the inner end surface 44*a* of the housing 18 directly contacts the inner end surface 44*a*. For example, in addition to the above-described embodiments, slidability may be given to the sliding surface between the housing 18 and the outer ring 22*a* by configuring such that a space to be filled with grease is formed on the sliding surface between the housing 18 and the outer ring 22*a* and interposing the grease on the sliding surface.

In an embodiment, as shown in FIG. 2, the first rolling bearing 16A further includes an annular sleeve member 52 fitted into the outer circumferential surface 23*b* of the outer ring 22*a*. Further, the elastic members 26*a* and 26*b* are disposed between an outer circumferential surface of the sleeve member 52 and the inner peripheral surface of the housing 18. Then, the sliding portion 28 (28B) is constituted by the sliding member disposed between the opposite surface of the sleeve member 52 opposite to the housing 18 in the axis CA direction and the opposite surface of the housing 18 opposite to the sleeve member 52 in the axis CA direction. According to the present embodiment, with the sleeve member 52, the sliding portion 28 (28B) is easily installed between the housing 18 and the outer ring 22*a*. Further, by appropriately selecting the shape or size of the sleeve member 52, it is possible to expand the degree of freedom in shape or size of the sliding portion 28 (28B) disposed in the sleeve member 52.

In an embodiment, as shown in FIG. 2, the sleeve member 52 is composed of a cylindrical body 54 having a cylindrical inner circumferential surface in contact with the outer circumferential surface 23*b* of the outer ring 22*a*, and a donut-shaped disc 56 formed integrally with the cylindrical body 54 and extending from axial one end of the cylindrical body 54 along the radial direction of the rotational shaft 12. Then, the sliding member 28 (28B) is disposed between an opposite surface 56*a* of the disc 56 opposite to the housing 18 and the opposite surface of the housing 18. By appropriately adjusting the dimension of the disc 56 in the extension direction, it is possible to expand the degree of freedom in arrangement of the housing 18 or arrangement of the sliding member 28 (28B) in the radial direction of the rotational shaft 12. Further, as the sliding member, it is possible to adopt the sliding members according to the various embodiments described above, without being limited to the sliding member 28 (28B).

In an embodiment, the sliding portion 28 (28B) is composed of the opposite surface 56*a* of the sleeve member 52. According to the present embodiment, since the opposite surface 56*a* of the sleeve member 52 in sliding contact with the inner end surface of the housing 18 is constituted by the sliding portion 28 (28B), by arranging just the sleeve member 52, it is possible to give slidability on the sliding surface between the housing 18 and the outer ring 22*a*. Thus, it is possible to simplify and reduce the cost of the arrangement of the sliding portion 28.

In an embodiment, the opposite surface of the housing 18 in sliding contact with the opposite surface 56*a* is constituted by the opposite surface 44*a* formed on the partition wall 44. Then, the end surface 56*a* of the disc 56 of the sleeve member 52 in sliding contact with the end surface 44*a* constitutes the sliding portion 28 (28B). The sliding portion 28 (28B) can adopt the various embodiments described above.

The embodiments shown in FIGS. 1 to 3 are the embodiments applied to the electric compressor. However, the application target is not limited to the electric compressor, and can also be applied to, for example, a compressor incorporated into a turbocharger.

The contents described in the above embodiments would be understood as follows, for instance.

(1) A compressor (10 (10A, 10B, 10C)) according to one aspect includes: a rotational shaft (12) provided with a compressor impeller (14) on one end side; a rolling bearing device (16A, 16B) for rotatably supporting the rotational shaft; and a housing (18) for housing the rolling bearing device. The rolling bearing device includes: an inner ring (20*a*) mounted on the rotational shaft; an outer ring (22*a*) supported by the housing with application of a load from the housing in an axial direction of the rotational shaft; a rolling element (24*a*) disposed between the inner ring and the outer ring; an elastic member (26*a*, 26*b*) disposed on an outer circumferential side of the outer ring so as to come into contact with the housing; and a sliding portion (28) disposed on one end side of the outer ring in the axial direction of the rotational shaft so as to come into contact with the housing.

With such configuration, since the above-described sliding portion is disposed between the housing and the outer ring so as to come into contact with the housing, smooth sliding between the housing and the outer ring is possible, making it possible to sufficiently exert the vibration damping effect on the rotational shaft system by the elastic member. Further, since the housing and the outer ring slide smoothly by the above-described sliding portion, it is possible to suppress wear of the housing or the outer ring. Thus, it is possible to suppress that the axial position of the rolling bearing device deviates from the initial position.

(2) A compressor according to another aspect is the compressor defined in (1), where the elastic member is disposed between an outer circumferential surface of the outer ring and an inner peripheral surface of the housing, and the sliding portion is constituted by a sliding member (28 (28A, 28B, 28C)) disposed between one end surface (23*a*) on the one end side of the outer ring in the axial direction and an inner end surface (44*a*) on one end side of the housing in the axial direction.

With such configuration, since the above-described elastic member is disposed between the outer circumferential surface of the outer ring and the inner peripheral surface of the housing, the radial direction of the rotational shaft system and the direction in which the vibration damping force of the elastic member is applied coincide with each other. Thus, the vibration damping effect by the elastic member can be maximized against the radial vibration of the rotational shaft system. Further, since the above-described sliding portion is constituted by the sliding member disposed between the outer ring and the housing, the outer ring and the housing do not contact directly. Therefore, it is possible to suppress the wear of the sliding contact surface of the outer ring and the housing which has conventionally been caused.

(3) A compressor according to still another aspect is the compressor defined in (1), where the rolling bearing device further includes an annular sleeve member (52) fitted into an outer circumferential surface of the outer ring, the elastic member is disposed between an outer circumferential surface of the sleeve member and an inner peripheral surface of the housing, the sliding portion is constituted by a sliding member disposed between one end surface (56*a*) on one end side of the sleeve member in the axial direction and an inner end surface (44*a*) on one end side of the housing in the axial direction.

With such configuration, since the sliding member is disposed between the sleeve member and the housing described above, by appropriately selecting the shape or size of the sleeve member, the sliding member is easily installed between the housing and the outer ring, as well as it is possible to expand the degree of freedom in shape or size of the sliding member.

(4) A compressor according to yet another aspect is the compressor defined in (2) or (3), where the sliding member (28 (28A)) is constituted by a resin plate member.

With such configuration, since the sliding member is constituted by the resin plate member, it is possible to reduce the cost of the sliding member, as well as to easily dispose the sliding member.

(5) A compressor according to yet another aspect is the compressor defined in (2) or (3), where the sliding member (28 (28B)) is constituted by an annular elastic member.

With such configuration, since the existing elastic member such as the O-ring can be used, it is possible to reduce the cost of the sliding member, as well as to easily dispose the sliding member. Further, since the annular sliding member is disposed in the entire circumferential region of the rotational shaft, it is possible to improve the slidability between the housing and the outer ring.

(6) A compressor according to yet another aspect is the compressor defined in (2) or (3), where the sliding member (28 (28C)) is constituted by a dry bearing.

With such configuration, since the sliding member is constituted by the dry bearing, it is possible to stably exhibit the high level of sliding performance between the housing and the outer ring without supplying oil.

(7) A compressor according to yet another aspect is the compressor defined in (1), where the rolling bearing device further includes an annular sleeve member fitted into an outer circumferential surface of the outer ring, the elastic member is disposed between an outer circumferential surface of the sleeve member and an inner peripheral surface of the housing, and one end surface (56*a*) on one end side of the sleeve member in the axial direction is configured to be in sliding contact with an inner end surface on one end side of the housing in the axial direction, and the sliding portion is constituted by the one end surface (44*a*) of the sleeve member.

With such configuration, since the one end surface of the sleeve member in sliding contact with the inner end surface of the housing is constituted by the sliding portion, by arranging just the sleeve member, it is possible to improve slidability between the housing and the outer ring. Therefore, since it is not necessary to provide an additional sliding portion, it is possible to simplify and reduce the cost of the configuration.

REFERENCE SIGNS LIST

10 (10A, 10B, 10C) Electric compressor
12 Rotational shaft
12*a* Large diameter portion
12*b* Small diameter portion
13*a*, 13*b* Step surface
14 Compressor impeller
16A First rolling bearing (rolling bearing device)
16B Second rolling bearing
18 Housing
20*a*, 20*b* Inner ring
22*a*, 22*b* Outer ring
23*a* End surface
23*b* Outer circumferential surface
24*a*, 24*b* Rolling element
26*a*, 26*b* Elastic member
28 Sliding portion
28 (28A, 28B, 28C) Sliding member
30 Electric motor
32 Rotor
34 Stator
36 Stator core
38 Coil
40 Compressor cover
42 Sleeve
44 Partition wall
44*a* Inner end surface (opposite surface)
46 Spring member
48*a*, 48*b* Annular portion
49 Recess
50, 51 Recess
52 Sleeve member
54 Cylindrical body
56 Disc
56*a* Opposite surface (end surface)
CA Axis

The invention claimed is:

1. A compressor, comprising:
a rotational shaft provided with a compressor impeller on one end side;
a rolling bearing device for rotatably supporting the rotational shaft; and
a housing for housing the rolling bearing device,
wherein the rolling bearing device includes:
an inner ring mounted on the rotational shaft;
an outer ring supported by the housing with application of a load from the housing in an axial direction of the rotational shaft;
a rolling element disposed between the inner ring and the outer ring;
an elastic member disposed on an outer circumferential side of the outer ring so as to come into contact with the housing; and
a sliding portion disposed on one end side of the outer ring in the axial direction so as to come into contact with the housing,
wherein the elastic member is disposed between an outer circumferential surface of the outer ring and an inner peripheral surface of the housing,
wherein in a state where the elastic member is in contact with the inner peripheral surface of the housing and the outer circumferential surface of the outer ring, a predetermined gap is formed between the inner peripheral surface of the housing and the outer circumferential surface of the outer ring to allow elastic deformation of the elastic member, and
wherein the sliding portion is constituted by a sliding member disposed between one end surface on the one end side of the outer ring in the axial direction and an inner end surface on one end side of the housing in the axial direction.

2. The compressor according to claim 1,
wherein the sliding member is constituted by a resin plate member.

3. The compressor according to claim 1,
wherein the sliding member is constituted by an annular elastic member.

4. The compressor according to claim 1,
wherein the sliding member is constituted by a dry bearing.

5. A compressor, comprising:
a rotational shaft provided with a compressor impeller on one end side;
a rolling bearing device for rotatably supporting the rotational shaft; and
a housing for housing the rolling bearing device,
wherein the rolling bearing device includes:
an inner ring mounted on the rotational shaft;
an outer ring supported by the housing with application of a load from the housing in an axial direction of the rotational shaft;
a rolling element disposed between the inner ring and the outer ring;
an elastic member disposed on an outer circumferential side of the outer ring so as to come into contact with the housing; and
a sliding portion disposed on one end side of the outer ring in the axial direction so as to come into contact with the housing,
wherein the rolling bearing device further includes an annular sleeve member fitted into an outer circumferential surface of the outer ring,
wherein the elastic member is disposed between an outer circumferential surface of the sleeve member and an inner peripheral surface of the housing,
wherein in a state where the elastic member is in contact with the inner peripheral surface of housing and the outer circumferential surface of the sleeve member, a predetermined gap is formed between the inner peripheral surface of the housing and the outer circumferential surface of the sleeve member to allow elastic deformation of the elastic member, and
wherein the sliding portion is constituted by a sliding member disposed between one end surface on one end side of the sleeve member in the axial direction and an inner end surface on one end side of the housing in the axial direction.

6. The compressor according to claim 5,
wherein the sliding member is constituted by a resin plate member.

7. The compressor according to claim 5, wherein the sliding member is constituted by an annular elastic member.

8. The compressor according to claim 5, wherein the sliding member is constituted by a dry bearing.

9. A compressor, comprising:

a rotational shaft provided with a compressor impeller on one end side;

a rolling bearing device for rotatably supporting the rotational shaft; and a housing for housing the rolling bearing device, wherein the rolling bearing device includes:

an inner ring mounted on the rotational shaft;

an outer ring supported by the housing with application of a load from the housing in an axial direction of the rotational shaft;

a rolling element disposed between the inner ring and the outer ring;

an elastic member disposed on an outer circumferential side of the outer ring so as to come into contact with the housing; and a sliding portion disposed on one end side of the outer ring in the axial direction so as to come into contact with the housing, wherein the rolling bearing device further includes an annular sleeve member fitted into an outer circumferential surface of the outer ring, wherein the elastic member is disposed between an outer circumferential surface of the sleeve member and an inner peripheral surface of the housing, wherein in a stage where the elastic member is in contact with the inner peripheral surface of the housing and the outer circumferential surface of the sleeve member, a predetermined gap is formed between the inner peripheral surface of the housing and the outer circumferential surface of the sleeve member to allow elastic deformation of the elastic member, wherein one end surface on one end side of the sleeve member in the axial direction is configured to be in sliding contact with an inner end surface on one end side of the housing in the axial direction, and wherein the sliding portion is constituted by the one end surface of the sleeve member.

* * * * *